US007677297B2

(12) United States Patent
Sundarraj et al.

(10) Patent No.: US 7,677,297 B2
(45) Date of Patent: Mar. 16, 2010

(54) REDUCING RESIDUAL STRESSES DURING SAND CASTING

(75) Inventors: Suresh Sundarraj, Bangalore (IN); Parag Agarwal, Pune (IN); Anil K. Sachdev, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 83 days.

(21) Appl. No.: 11/770,847

(22) Filed: Jun. 29, 2007

(65) Prior Publication Data

US 2009/0000756 A1 Jan. 1, 2009

(51) Int. Cl.
*B22C 1/02* (2006.01)
*B22C 1/04* (2006.01)

(52) U.S. Cl. ..... 164/520; 164/523

(58) Field of Classification Search ..... 164/520–528
See application file for complete search history.

(56) References Cited

U.S. PATENT DOCUMENTS 5,355,931 A * 10/1994 Donahue et al. ..... 164/34

FOREIGN PATENT DOCUMENTS

JP 57-11747 * 1/1982
JP 57142742 9/1982
SU 456674 1/1973
WO WO9841408 9/1998

OTHER PUBLICATIONS

Heusler L.; "Les Alliages Legers Coules En Sable Ou En Coquille. L 'Aluminum: Les Fondements Metallurgiques, Les Materiau Et Leurs Caracteristiques"; Fonderie, Fondeur D'Aujourd 'Hui, Editions Techniques Des Industries De La Fonderie, Sevres, FR, No. 269. Nov. 1, 2007; pp. 36-41.

Beauvais, P. et al.; "Les Sables A Prise Chimique; Oiere Partie: Historique—Description Des Procedes" Fonderie, Fondeur D'Aujourd 'Hui, Editions Techniques Des Industries De La Fonderie, Sevres, FR, No. 143, Mar. 1, 1995, pp. 22-35.

European Search Report for EP08 01 0452 dated Jul. 9, 2008.

* cited by examiner

*Primary Examiner*—Kuang Lin

(57) ABSTRACT

Residual stress is reduced in light metal alloy articles, e.g. aluminum alloy articles, formed as castings against a sand casting mold body by incorporating a wax composition of suitable softening or melting temperature with the sand particles of the mold or core body. The hot cast metal heats adjoining surfaces of the mold body. As the cooling metal forms a solid shell, the surrounding sand particle and wax mixture are heated sufficiently to melt or soften the wax incorporated on or between sand particles. This softens portions of the rigid mold body that could otherwise restrain shrinking surfaces of the casting and produce unwanted stressed regions that are retained in the casting and must be removed by subsequent processing.

18 Claims, 2 Drawing Sheets

REDUCING RESIDUAL STRESSES DURING SAND CASTING

TECHNICAL FIELD

This invention pertains to the casting of molten metal against sand mold surfaces or sand core surfaces in making cast articles. More specifically, this invention pertains to making such sand particle casting bodies so as to minimize cracks, residual stresses, and the like in light metal alloy castings.

BACKGROUND OF THE INVENTION

The art of casting molten metal into sand molds to make useful articles has long been practiced. The casting art also includes casting molten metal into permanent molds in which sand cores are used to define internal surfaces of the casting. Today many ferrous and non-ferrous metal alloys are cast in green sand molds, resin bonded sand molds, or in other more permanent mold material structures using sand cores to define a portion of the surfaces of the cast articles.

Aluminum alloys are used in producing many cast articles, particularly in the automobile industry. Many engine components and other drive-train components are cast of various aluminum alloys in sand molds, and aluminum parts are produced by die casting or permanent mold casting in which sand cores are used. For example, there is a family of aluminum-based alloys variously containing, by weight, about five to twelve percent silicon, and smaller amounts of other alloying constituents such as copper, magnesium, and/or zinc. These alloys have good fluidity at pouring temperatures of, for example, about 700° C. for flowing into intricately shaped mold cavities in such casting practices.

Molding sand materials containing fine silica sand particles and small amounts of clay and water may serve as the mold or core material for casting aluminum alloys and other light metal alloys such as magnesium alloys. The pouring temperatures of these casting alloys are relatively low (as compared, e.g., to ferrous alloys or other higher melting point metal alloys) and special, high temperature resistant mold compositions are not normally required. Complex parts such as aluminum alloy engine cylinder blocks, engine head blocks and the like may be cast in sand molds with sand cores to good dimensional accuracy. But aluminum alloys have a high volumetric shrinkage upon solidification, and there is additional shrinkage as solidified cast metal experiences further cooling. The sand mold body is initially at ambient temperature and it has relatively low thermal conductivity. Those portions of the mold close to the mold cavity are heated by the sudden charge of hot metal. So mold surfaces and cores may expand in directions that press against surfaces of the solidifying cast metal. There are shapes in aluminum castings, such as those formed by surfaces in the cast body having intersecting faces at angles of about ninety degrees and lower, which may shrink extensively against acute angles (for example), adjacent sand mold surfaces and experience unwanted compressive or tensile stresses. This mold surface induced stress may cause cracks in affected surface regions of the cast light metal article. But more commonly, the cooled casting has regions of residual compressive or tensile stresses that may have to be relieved by a costly heat treatment.

There is a need for a method of making sand molds and sand cores that reduce such thermal shrinkage damage to cast light metal alloy parts.

SUMMARY OF THE INVENTION

In accordance with an embodiment of the invention, a mixture of sand particles and wax is used in making a core or a mold body (or a portion of a mold body) for casting aluminum alloys. In one embodiment, wax particles may be mixed and blended with sand particles in making the mold body. In another embodiment a solvent may be used to disperse the wax onto the surfaces of the grains of sand. The solvent may then be evaporated and the wax-coated grains of sand formed into the mold body or component. An entire mold may be formed of wax-containing sand. Alternatively, wax is used in making sections of the mold to lie near those cavity-defining surfaces where prior shape analysis or thermal analysis indicates that the mold (or core) may restrict shrinkage of the solidifying and cooling cast part and thereby damage the casting.

A wax material is selected that will melt (or soften appreciably) when a cast metal-heated mold section reaches a predetermined temperature (e.g., about 250° C.). The melted wax produces a softening of the heated region of the sand mold or core and that mold region provides less restraint to the enclosed hot cast body. Often the cast metal forms a solid shell by the time the wax melts and the shell helps to sustain the intended article shape as the molten interior solidifies and cools. Depending on the mold section structure, the melted wax may drain from the hot mold region and create porosity in the mold that reduces its restraint of the cast part. Whatever the mechanism, this softening of adjacent or nearby mold or core surfaces reduces the incidence of residual stress in the cast article.

High melting point waxes are known that are suitable for use with sand particles in mold bodies for casting aluminum alloys. For example, polymeric reaction products of linear $C_6$-$C_{12}$ dicarboxylic acids and a diamine of the formula, $H_2N(CH_2)_nNH_2$, are commercially available as waxes with different melting point ranges. A wax with a specific melting range may be chosen by experience or pre-testing for use in casting a specific article shape of a specific alloy composition and pouring temperature.

In accordance with a practice of the invention, an analysis is made of the shape of an article to be cast using an aluminum alloy, magnesium alloy or other light metal alloy. Shape features of the article that may experience mechanical constraint due to shrinkage when cast in a sand mold are identified by observation or experience, and/or by structural and/or thermal analytical methods. This analysis may be performed, for example, using a suitable computer software program. Problems tend to arise in portions of a casting in which article surfaces merge, for example, at about ninety degrees or smaller angles. Some such shapes occur, for example, where the casting is shrinking around a relatively sharp edge or surface on the mold or core body. Such mold surfaces occur, for example, at the bottom of a cup-like structure where shrinkage of the casting occurs around a complementary cylindrical core. A cast shape having an I-section may likewise experience stress where the head and column of the "I" intersect and shrink against the complementary corner of the mold body. The method of this invention is practiced to minimize mold-caused compressive or tensile stresses on surfaces of the cast body.

Depending on the article to be cast, an entire sand mold (or core body) may be formed with wax coated on or filled between the sand particles. Or where it is convenient to prepare the mold in sections, selected mold sections may be made to include wax with a suitable melting point to minimize shrinkage restraint of the cast article, Critical surfaces of the mold or core are formulated with a wax and sand particle mixture in which the wax is selected to melt before the casting is damaged; for example, after a coextensive solid shell has formed around the remaining molten liquid. Melting of the wax alters the rigidity of a mold region in which it is contained in suitable quantity to reduce stress imparted to the hot, fragile casting.

Other objects and advantages of the invention will be apparent from the following descriptions of preferred embodiments.

DESCRIPTION OF PREFERRED EMBODIMENTS

Figure 1:
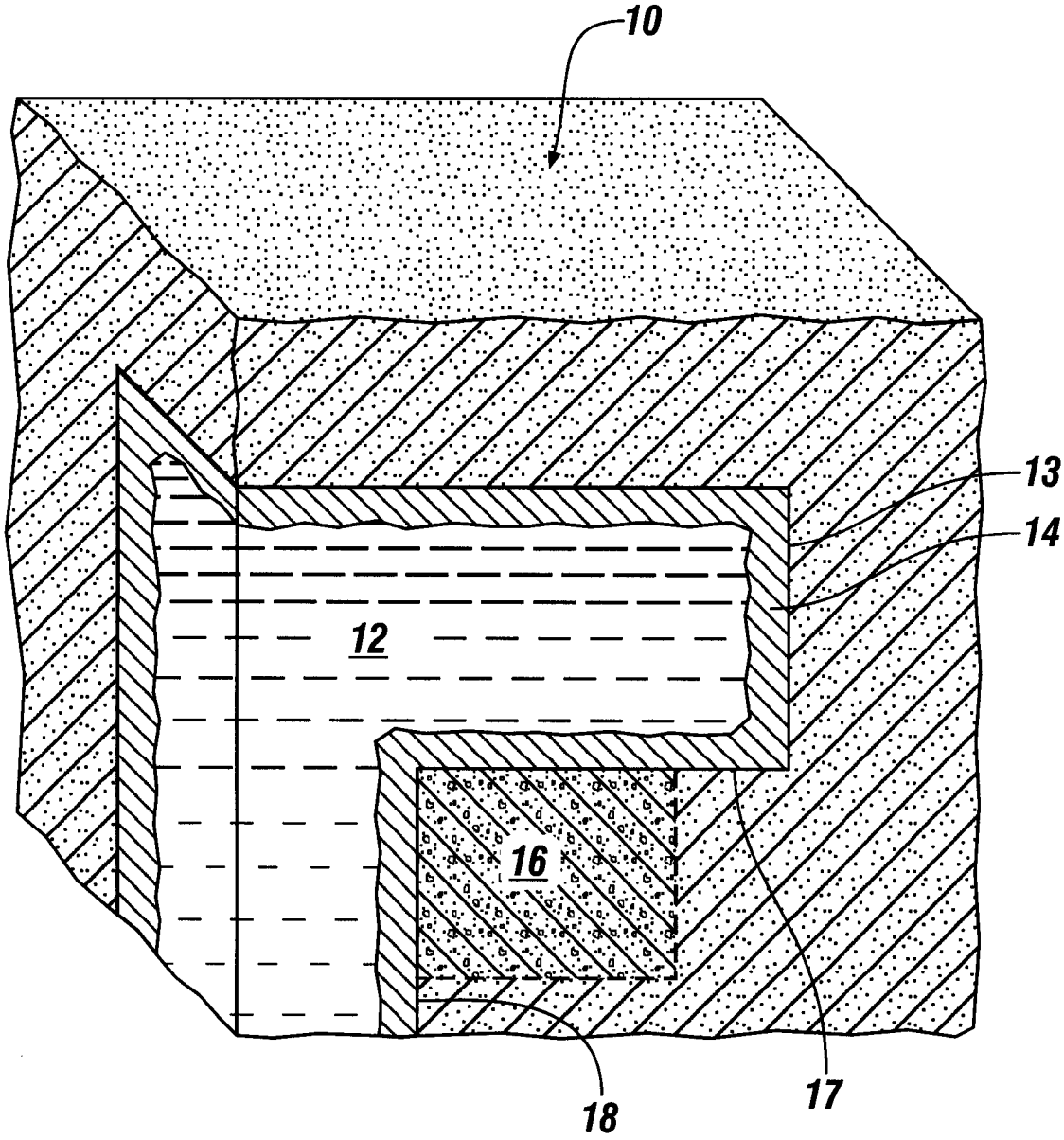
FIG. 1 is a side elevational view, partly in cross-section; illustrating a one-eighth section of an I-shaped aluminum alloy cast body and a sand particle mold. This view illustrates a momentary stage in the casting process in which molten aluminum alloy has been poured and a solidified shell has formed against the mold surface. This figure illustrates a selected region of the mold which is made with a wax and sand mixture to reduce compressive restraint at the intersection of the head and body portions of the I-structure.

Compressive stresses may be applied to hot cast metal by adjacent sand mold surfaces as mold surfaces, heated by the hot cast metal, expand and cast metal surfaces cool and contract against the mold surfaces. This phenomenon arises, in part, from the incidence of thermal stresses generated in castings during solidification due to the difference in the coefficients of thermal expansion (CTE) of the hot solidified material and of the sand mold. When the hot metal is poured into the article-shaping cavity of an unheated sand mold, it loses (transfers) heat to the sand and as a result the adjacent mold material heats up and expands slightly. As the metal starts to solidify it contracts due to solidification shrinkage. Depending on the shape of the casting and mold cavity, the mismatch between the casting CTE and the sand mold CTE may cause mold/metal gap formation at certain locations and compressive engagement of the casting with the mold at other locations. In the former situation the cast metal shrinks away from the sand mold surface, while in the latter situation the casting shrinks against a mold surface. Shrinkage of cast material against a mold surface is constrained due to the resistance offered by the more rigid mold. Sometimes the shrinking metal encounters surfaces in a mold body intersection at more or less acute angles. This type of constraint, for example, may cause compressive or tensile stresses to develop in the casting. Usually such compressive or tensile stresses must be removed by an expensive heat treatment of the casting before the cast article is considered suitable for its intended use.

A method is provided for making a composite mold body of sand particles and a wax composition such that the incidence of residual compressive or tensile stresses in an aluminum alloy casting is reduced. A wax material is selected with a melting point such that heated regions of the mold body soften after the cast metal has formed a solid shell. The invention may be applied in the casting of other light metal alloys.

A wax composition is selected for mixture with sand particles in forming a mold body or core surface. Waxes are soft polymeric materials that may be mixed with sand particles or deposited on sand particles from a suitable removable solvent. In one embodiment a wax-like material is identified by, for example, a simple experiment or experience to soften sand particles in a mold body. The softening occurs due to the melting or softening of the sand and wax mixture due to heating from the cast metal. A wax is selected that softens regions of the mold body against which the cast metal may be expected to shrink. The melting point of the wax is selected so that the mold or core section may soften after a solid shell has formed on the cast metal and before the casting has hardened to the stage in which compressive or tensile stresses are frozen into the cast structure. In casting of aluminum alloy castings, for example, it is found that polymer waxes melting in the region of about 225° C. to about 275° C. are often suitable. As stated, the selection of a specific wax for the casting of a specific casting alloy into a predetermined article shape may be made by trying different waxes in different mold bodies while making a number of trial castings of the part to be made in large volume production. Alternatively, a casting simulation model or procedure can be used to determine the wax characteristics for the specific geometry of the cast article and the temperature of the cast metal.

Waxes are available that are formed of carbon, hydrogen, and oxygen-containing polymers and carbon, hydrogen, oxygen, and nitrogen-containing polymers. Typically these polymers are made of repeating monomer units in the polymer molecular chain. When the polymerization is stopped after the inclusion of, for example, about five to about ten monomer units the product has the characteristics of a wax. The molecular weight range of a particular mixture determines characteristics of the wax-like material. Each such wax may be used in the form of soft pliable particles having a melting range related generally to its molecular weight and monomer chain length. Or the wax may be dispersed in a solvent vehicle and deposited in the sand particles. One example of waxes suitable for selection and use in mold bodies of this invention are polymeric polyamide reaction products of linear $C_6$-$C_{12}$ dicarboxylic acids and a diamine of the formula, $H_2N(CH_2)_nNH_2$. Depending on the degree of polymerization waxes in this group of polymers may be prepared with individual melting points or ranges in a broad range of form about 200° C. to about 300° C.

A practice of the invention will be illustrated by reference to FIG. 1. As stated, FIG. 1 illustrates a one-eighth section of a sand-particle mold 10 for casting of an I-shaped aluminum alloy cast body. An upper-quarter section of the sand mold 10 is illustrated in FIG. 1. Mold 10 has cavity defining surfaces, for example surface 13, which are formed in sand mold 10 to confine the cast metal in the shape of the I-shaped body. A volume of molten aluminum 12 has been poured into the cavity of mold 10 through a mold gating and runner system, not shown in FIG. 1. Mold 10 is initially at about ambient temperature and the hot (e.g., about 700° C.) molten aluminum alloy melt is rapidly cooled and forms a solidified skin 14 on cavity defining surfaces (e.g., surface 13) of the mold body.

Mold cavity surfaces 17 and 18 define a portion of the I-shaped body where the head of the I-shaped body meets the vertical column of the body. This is a region of the cast body at which the casting may be expected to shrink against the substantially right angle edge formed by the intersection of mold cavity surfaces 17, 18. Thus, a separate mold section 16 of mold has been prepared in which the sand particles are mixed with wax particles. Mold section 16 is assembled with the main portion of mold body 10 before the casting is poured.

As heat from the volume of cast molten metal 12 is conducted through solidified skin 14, the surrounding regions of sand mold 10 and mold section 16 are heated. Mold section 16 contains a mixture of sand and wax in which the wax melts, for example at temperatures in the range of about 225° C. to about 275° C., to weaken mold section 16 and any other wax-containing sections of sand mold body 10. The wax content of mold section 16 is suitable (for example, up to about fifty percent by weight of sand plus wax mixture) to weaken mold section 16 to minimize residual stress in the final solidified cast structure.

A computer simulation of coupled thermal-stress analysis was carried out for this one-eighth I-section part (as depicted in FIG. 1) with (a) sand mold only (first simulation) and (b) sand mold embedded with wax mixture (second simulation) using a commercial casting software called ProCAST®. The ProCAST® database values of the material properties pertaining to aluminum-silicon alloy (like cast metal 12 in FIG. 1) and a sand mold (like mold 10 in FIG. 1 but without a wax containing mold section 16) were used in these simulations.

The results from the first simulation indicated that (not shown in the Figures) the maximum residual stress encountered by the casting was at the intersection of mold cavity surfaces 17 and 18 and that residual stress was approximately 90 MPa after the entire liquid metal had solidified (i.e., past the casting stage of skin formation 14 as depicted in FIG. 1). The second simulation used the same conditions as the first except that the CTE for the composite mold part 16 was changed from $10^{-5}$/° C. to $-10^{-5}$/° C. at a temperature higher than 200° C. to simulate the softening effect due to the presence of wax at the same location of intersection between mold surfaces 17 and 18 in the casting 14 region. The second simulation indicated the maximum residual stress to be 60 MPa. These results confirm the benefit of the use of a wax-continuing mold section 16 in the "I" casting embodiment. The computer simulation estimated reduction in residual stress in the corner section was about 30%.

Figure 2:
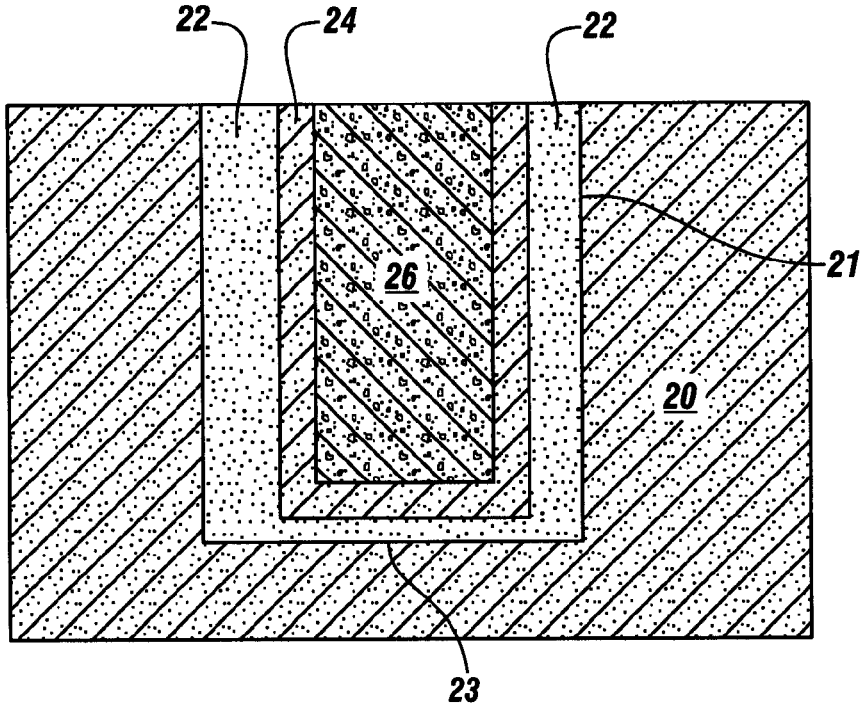
FIG. 2 is a side elevational view illustrating a cross-section of a sand mold for casting an aluminum alloy cup-shape. This sectional view illustrates an embodiment in which a core is used with a hollow thin-wall sand particle outer structure and a cylindrical wax-sand particle inner structure.
Figure 3:
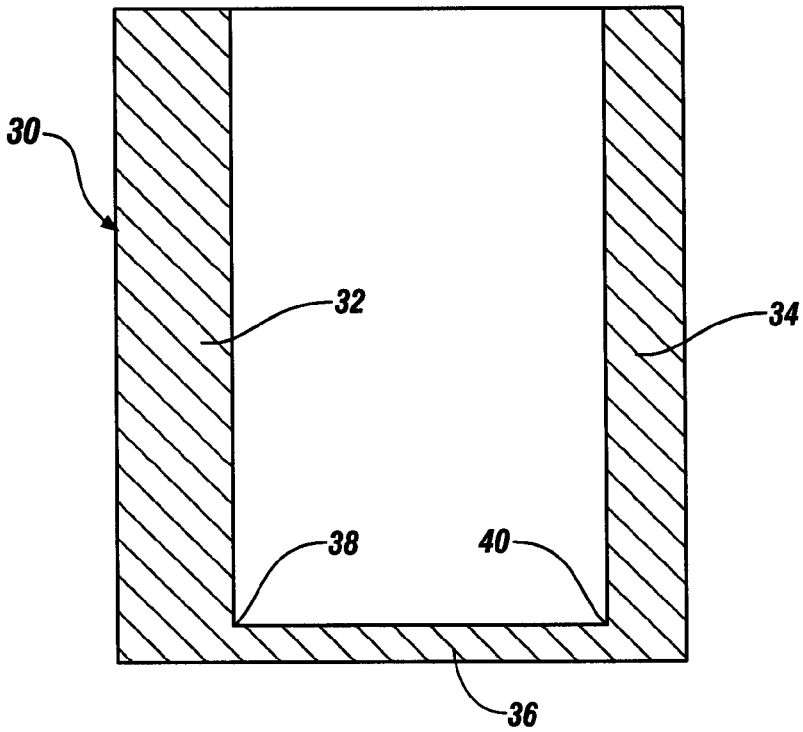
FIG. 3 is a side view in cross-section of a cup of un-equal wall thickness as cast in the mold arrangement of FIG. 2.

Another embodiment of the invention will be illustrated by reference to FIGS. 2 and 3. FIG. 2 is an elevational view, in cross-section, of sand mold body 20 for casting a round cylindrical cup structure 30 as illustrated in cross-section in FIG. 3. Cup structure 30 is representative of cast articles that have a cup portion with vertical wall segments 32, 34 of varying thickness and a base portion 36 of still a different dimension. Wall segments 32, 34 form substantially right angle intersections at arc segments 38, 40 with base portion 36. The right angle between wall segments 32, 34 and base 36 means that there is a likelihood of residual stress being present in an article produced by casting a molten aluminum alloy (or an alloy of another light metal) in a sand mold. Other acute angle intersections between walls of cast articles present like situations for the retention of stress in a cast light metal article.

In this embodiment, sand mold 20 (FIG. 2) may be formed of sand particles bonded with water moistened clay particles. Sand mold 20 defines mold cavity 22 for the casting of cup 30 (FIG. 3). Sand mold 20 has a round cylindrical surface 21 defining mold cavity 22. Mold surface 21 also defines the exterior walls of cup 30, and a round flat surface 23 defining the exterior bottom surface of cup 30. Sand mold 20 would likely also have a gating and runner system, not shown, for pouring molten aluminum alloy to fill cavity 22 by molten metal flow into the bottom of cavity 22 and then upwardly into the vertical walls of the cavity.

Supported on bottom mold surface 23 with aluminum alloy chaplets or the like (not shown) is a thin wall, cup shaped, sand particle core 24 for defining the interior surfaces of arcuate wall portions 32, 34 and the base portion 36 of cup 30. Inserted within thin wall, sand particle core 24 is a second core body 26 that is cylindrical and composed of a mixture of sand particles and wax. (Note: alternatively, instead of a second core body the core itself may be formed of a mixture of sand and wax, with the wax dispersed in selected regions within the core). The cylindrical and bottom walls of sand particle core 24 are thin (for example a couple of millimeters thick) to maintain structural integrity of cavity 22 for the accurate shaping of cup 30 as solidified metal skin forms on the surfaces of mold 20 and core 24. But the thin walled core 24 in not strong enough to cause residual stress in regions 38, 40 of cast cup 30. Moreover, the wax composition and content of core 26 is such that the wax softens or melts as solidification of cup 30 continues. Suitable softening of wax and sand particle core 26 contributes to the residual stress-free casting of cup 30.

Mixtures of wax and sand-containing casting molds and cores are, thus, used to reduce the formation of residual stress in aluminum alloy castings and other light metal alloy castings. The shape of a potential casting and mold arrangement is evaluated to pre-determine the location of potential residual stress caused by shrinkage of the solidifying and cooling casting against a rigid mold or core surface. Such mold body surfaces are suitably weakened by helpful placement of a softenable mold structure. The mold structure is made softenable by use of a suitable wax. The composition of the wax is selected to melt or soften at a mold body temperature when the fragile casting is shrinking against the casting-heated mold body surface.

In one embodiment, wax particles may be mixed with sand particles to form a softenable mold body member. In another embodiment, sand particles may be coated using a solution of the wax with subsequent solvent removal as necessary.

The practice of the invention has been illustrated with examples of some specific embodiments. But the illustrations are not intended to be limiting of the scope of the invention. A worker skilled in the arts of metal casting and mold construction will recognize that other embodiments of the invention will readily be adaptable for other cast article shapes and other casting situations.

The invention claimed is:

1. A method of making a sand particle-containing mold body for casting articles of light metal alloys where article-shaping surfaces of the mold body are heated by the cast metal and at least a portion of the surface of the cast article shrinks against an article-shaping surface of the mold body as the cast metal solidifies and cools, the method comprising:

identifying a region of the mold body wherein a surface of the cast article may shrink against a portion of the article-shaping surface of the mold body during solidification of cast light metal alloy and sustain residual compressive or tensile stresses in that surface of the cast article;

selecting a wax composition and amount for mixing with sand particles used in making at least the identified region of the mold body, the wax composition and amount being selected to soften the identified region after an initial solidified shell of the cast article has formed during solidification of the casting and to reduce compressive or tensile stresses in the surface region of the cast article shrinking against the article-shaping surface of the mold, the amount of wax in the identified region being up to the weight of the sand particles; and mixing the selected wax composition and amount with sand particles in forming at least the identified region of the mold.

2. A method of making a sand particle-containing mold body as recited in claim 1 in which particles of the selected wax composition are mixed with sand particles.

3. A method of making a sand particle-containing mold body as recited in claim 1 in which the sand particles are coated with the selected wax composition.

4. A method of making a sand particle-containing mold body as recited in claim 1 in which the mold body is a core piece inserted in another mold body for the casting of the light metal alloy article.

5. A method of making a sand particle-containing mold body as recited in claim 1 in which the mold body is a section of an article-defining surface section assembled with another mold body for the casting of the light metal alloy article.

6. A method of making a sand particle-containing mold body as recited in claim 1 in which the light metal alloy is an aluminum alloy.

7. A method of making a sand particle-containing mold body as recited in claim 1 in which the wax composition is a polyamide reaction product of a linear $C_6$-$C_{12}$ dicarboxylic acid and a diamine of the formula, $H_2N(CH_2)_NH_2$.

8. A method of making a sand particle-containing mold body as recited in claim 1 in which the light metal alloy is an aluminum alloy and the melting range of the wax composition is above 200° C.

9. A method of making a sand particle-containing mold body as recited in claim 1 in which the light metal alloy is an aluminum alloy and the wax composition is selected to soften after an initial solidified shell of the cast article has formed.

10. A method of making an article of a light metal alloy by casting a melt of the light metal alloy against an article shape-defining surface of a sand particle-containing mold body where a surface of the cast article shrinks against an article shape-defining surface of the mold body as the cast metal forms an initial solidified shell and then fully solidifies and cools, the method comprising:

identifying a region of the mold body wherein a surface of the cast article may shrink against a portion of the article-shaping surface of the mold body during solidification of cast light metal alloy and sustain residual compressive or tensile stresses in that surface of the cast article;

making the mold body in which at least the identified region of whole mold body is made with a mixture comprising a wax composition and sand particles, the sand particles initially consisting essentially of sand, clay, and moisture for bonding as a mold body, the wax composition and its amount being selected by experimentation to soften after an initial solidified shell of the cast article has formed during solidification of the casting and to reduce compressive or tensile stresses in the surface region of the cast article shrinking against the article shape-defining surface of the mold;

pouring a melt of the light metal alloy against the mold body, the mold body initially being at an ambient temperature;

allowing the cast metal article to solidify and cool against the mold body surface; and, when the cast article has reached a suitable temperature for removal from contact with the mold body, removing the cast article from the mold body, the cast article having lower residual compressive or tensile stresses due to the softening of the wax composition.

11. A method of making an article of a light metal alloy as recited in claim 10 in which particles of the selected wax composition are mixed with sand particles.

12. A method of making an article of a light metal alloy as recited in claim 10 in which the sand particles are coated with the selected wax composition.

13. A method of making an article of a light metal alloy as recited in claim 10 in which the mold body is a core piece inserted in another mold body for the casting of the light metal alloy article.

14. A method of making an article of a light metal alloy as recited in claim 10 in which the mold body is a section of an article-defining surface section assembled with another mold body for the casting of the light metal alloy article.

15. A method of making an article of a light metal alloy as recited in claim 10 in which the light metal alloy is an aluminum alloy.

16. A method of making an article of a light metal alloy as recited in claim 10 in which the wax composition is a polyamide reaction product of a linear $C_6$-$C_{12}$ dicarboxylic acid and a diamine of the formula, $H_2N(CH_2)_NH_2$.

17. A method of making an article of a light metal alloy as recited in claim 10 in which the light metal alloy is an aluminum alloy and the melting range of the wax composition is above 200° C.

18. A method of making an article of a light metal alloy as recited in claim 10 in which the light metal alloy is an aluminum alloy and the wax composition is selected to soften after an initial solidified shell of the cast article has formed.

* * * * *